US008261500B2

(12) United States Patent
Sprague

(10) Patent No.: US 8,261,500 B2
(45) Date of Patent: Sep. 11, 2012

(54) WALL PANEL SYSTEM INCLUDING A RETRACTABLE FLOOR ANCHOR AND METHOD

(75) Inventor: Gary Sprague, Los Angeles, CA (US)

(73) Assignee: C.R. Laurence Company, Inc., Los Angeles, CA (US)

( * ) Notice: Subject to any disclaimer, the term of this patent is extended or adjusted under 35 U.S.C. 154(b) by 532 days.

(21) Appl. No.: 12/056,242

(22) Filed: Mar. 26, 2008

(65) Prior Publication Data

US 2009/0241445 A1 Oct. 1, 2009

(51) Int. Cl.
*E04H 1/00* (2006.01)

(52) U.S. Cl. ..... 52/243.1; 52/207; 160/200; 160/214; 292/139; 292/60; 292/165; 292/40

(58) Field of Classification Search ..... 49/127, 49/177, 183, 316, 320, 321, 348, 353, 358, 49/359, 404, 409, 411, 449; 52/64, 207, 52/243.1; 160/196.1, 200, 201, 205, 214; 109/70; 70/100; 292/165, 182, 163, 177
See application file for complete search history.

(56) References Cited

U.S. PATENT DOCUMENTS

| | | | | | |
|---|---|---|---|---|---|
| 475,686 | A | * | 5/1892 | Hauck | 292/60 |
| 1,294,949 | A | * | 2/1919 | Roberts | 70/120 |
| 1,524,005 | A | * | 1/1925 | Dodge | 160/113 |
| 1,970,807 | A | * | 8/1934 | Lovell | 292/165 |
| 2,034,570 | A | * | 3/1936 | Flavin | 292/65 |
| 2,124,970 | A | * | 7/1938 | Bagley | 292/40 |
| 2,202,916 | A | * | 6/1940 | Mussa | 292/177 |
| 3,072,975 | A | * | 1/1963 | Burmeister | 49/317 |
| 3,185,111 | A | * | 5/1965 | Hess | 410/135 |
| 3,295,257 | A | * | 1/1967 | Douglass | 49/317 |
| 4,619,095 | A | * | 10/1986 | Johnston | 52/592.3 |
| 4,872,286 | A | * | 10/1989 | Peirish et al. | 49/449 |
| 5,031,274 | A | | 7/1991 | Eutebach | |
| 5,090,171 | A | * | 2/1992 | Kano et al. | 52/243.1 |
| 5,426,892 | A | | 6/1995 | Haab et al. | |
| 5,467,559 | A | * | 11/1995 | Owens | 49/321 |
| 6,108,989 | A | * | 8/2000 | Kordes et al. | 52/243.1 |
| 6,167,937 | B1 | * | 1/2001 | Williams | 160/40 |
| 6,425,208 | B1 | * | 7/2002 | Klueger et al. | 49/502 |
| 7,357,428 | B2 | * | 4/2008 | Kletscher | 292/139 |
| 7,488,013 | B2 | * | 2/2009 | Urpolahti | 292/179 |
| 7,617,706 | B1 | * | 11/2009 | Kuo | 70/58 |

FOREIGN PATENT DOCUMENTS

| | | | |
|---|---|---|---|
| DE | 9300278 | U1 | 3/1993 |
| DE | 20306551 | U1 | 8/2003 |
| WO | 03/046324 | A1 | 6/2003 |

* cited by examiner

*Primary Examiner* — David Dunn
*Assistant Examiner* — David E Allred
(74) *Attorney, Agent, or Firm* — Mitchell P. Brook; McKenna Long & Aldridge LLP

(57) ABSTRACT

A wall panel system including a retractable floor anchor for converting a wall panel assembly between a sliding configuration and a pivoting configuration. The wall panel system includes a sliding wall panel assembly and a pivoting wall panel assembly that may be configured to slide or pivot. A retractable floor anchor configured to be included in the pivoting wall panel assembly includes retractable spindle that is coupled to a base member by a linear actuator. The spindle is rotatably coupled to a door closer included in the retractable floor anchor.

14 Claims, 16 Drawing Sheets

WALL PANEL SYSTEM INCLUDING A RETRACTABLE FLOOR ANCHOR AND METHOD

FIELD OF THE INVENTION

The present invention relates to movable wall panel systems and, in particular, to wall panel systems that include pivoting wall panel assemblies.

BACKGROUND OF THE INVENTION

Movable wall panels are often used to divide an area into two or more regions. For example, movable wall panels are employed in schools, hotels, and convention centers to divide a large room into two or more smaller rooms. Another common use of movable wall panels is the formation of individual shop fronts within a mall. Clear glass panels are typically stored during business hours to produce a wide-open storefront, and are disposed in front of the storefront during off-business hours while permitting the viewing of merchandise. Alternatively, the clear glass panels may be disposed in front of the storefront during business hours if desired, and one or more panels may be configured to pivot to provide access, for example during inclement weather.

Movable wall panel systems typically include several components, such as wall panels, trolleys coupled to the wall panels, and tracks within which the trolleys can slide and displace the wall panels. The wall panels often are large planar structures that may be separate or attached to one another end-to-end. Many modern applications of wall panel systems utilize separate wall panels in order to allow greater versatility than systems employing wall panels that are attached end-to-end.

Mechanisms may be included that allow a sliding panel to be converted into a pivoting panel. For example, U.S. Pat. No. 5,394,648 to Kordes discloses a door or wall partition panel that includes a unit for swinging and sliding the panel. The panel is pivotally coupled to a movable carrier that is suspended from a rail by a plurality of suspensions. A floor lock is included on a lower portion of the panel that provides for selectively locking and unlocking the door at a specific location. The floor lock also provides a hinging function for the swinging movement of the door when it is in the locked position. A fixing and locking unit is also included on the upper portion of the panel that is configured to selectively lock relative motion between the rail and the carrier and between the panel and the carrier. The fixing and locking unit includes a locking screw that may be moved independent of a fixing screw to restrict translation of the panel along the rail and/or pivoting motion of the panel relative to the carrier.

An example of a floor door lock is disclosed in U.S. Pat. No. 5,031,274 to Eutebach. The floor door lock includes a housing that is located inside a carrier, a pivotal arm, a lock pin and a blocking means. The pivotal arm is pivotally connected to the housing and the lock pin is fixed to the bottom of the pivotal arm. In a locked position, the pivotal arm is pivoted toward the floor so that the lock pin extends into a receiving opening in the floor. In an unlocked position, the pivotal arm is pivoted toward the door and into the housing so that the lock pin is disengaged from the receiving opening. The blocking means provides a control interface and is configured so that it is rotated to bear against the pivotal arm to pivot and retain the pivotal arm in the locked position.

In a still further example, U.S. Pat. No. 5,426,892 to Haab et al. discloses an anchoring mechanism for a swinging door that includes a wedge-shaped hinge part that moves along a vertical axis between a locked position and an unlocked position. A vertical edge of the hinge part includes a guide section that interfaces a guide groove included in a guide part that is mounted to a bottom frame strip of the swinging door. An inclined surface of the hinge part interfaces an inclined surface of a lowering part that moves along a horizontal axis. As the lowering part is moved along the horizontal axis, the interface between the inclined surfaces causes the hinge part to move vertically. A hinge stud extends from a bottom surface of the hinge part and when the anchoring mechanism is in a locked position, the hinge stud is received in a rotatable bush that is anchored in the floor. The bush may also be configured to provide resistance to the swiveling of the door and automatically closes the swinging door.

A significant disadvantage of the anchoring mechanisms described above is that the door lock and the rotatable bush assembly must be anchored in a cavity in the floor. As a result, if the door lock or bush is not installed during initial construction of the floor (which requires pre-planning as to the location of the wall panel assembly), an installer is required to perform the time consuming and difficult task of creating a sufficient cavity in the floor, oftentimes in concrete, and installing the assembly in that cavity. Another disadvantage of existing systems is that the door closer assemblies are large and unsightly and are exposed either as a floor mounted assembly or as a header assembly.

Accordingly, there is a need for a floor anchor that does not require installation of a rotating bush or door closer mechanism in a cavity in the floor. There is also a need for a door closer that may be installed in a door panel.

SUMMARY OF THE INVENTION

The present invention alleviates to a great extent the disadvantages of known door lock systems by providing a floor anchor and related method of use, in which one or more door panel assemblies are provided with a floor anchor that includes a retractable spindle. Additionally, a floor anchor is provided that also includes a door closer.

In an embodiment, a retractable floor anchor for a wall panel system includes a base member, a door closer assembly, a spindle and a linear actuator. The linear actuator moveably couples the base member to the spindle so that that the spindle may be vertically translated between a retracted position and an extended position. The spindle is rotatably coupled to the door closer assembly.

In another embodiment, a retractable floor anchor for a wall panel system includes a base member, a door closer assembly, a spindle and a linear actuator that moveably couples the base member to the door closer assembly. The spindle is rotatably coupled to the door closer assembly. The linear actuator includes a rotatable input camming link that is pivotally coupled to the base member and translatably coupled to the door closer assembly. The rotatable input camming link is adapted to rotate between a first position and a second position. The door closer assembly is in a retracted position when the input camming link is in the first position and the door closer assembly is in an extended position when the input camming link is in the second position.

A wall panel system is provided that includes a track, at least one sliding wall panel assembly and at least one pivoting wall panel assembly. The sliding wall panel assembly is translatably coupled to the track, and includes an upper rail, a lower rail and a wall panel fixedly coupled to each of the upper rail and the lower rail and interposed therebetween. The pivoting wall panel assembly is translatably coupled to the track, and includes a slide rail, a pivot rail, a wall panel, a lower rail, a door closer assembly, a spindle and a linear actuator. The pivot rail is pivotally coupled to the slide rail, and the wall panel is fixedly coupled to the pivot rail. The lower rail is coupled to a second side of the wall panel opposite the pivot rail. The retractable floor anchor is coupled to the lower rail and includes a base member, a door closer assembly, a spindle and a linear actuator. The spindle is rotatably coupled to the door closer assembly. The linear actuator moveably couples the base member to the spindle and is adapted to translate spindle relative to the base member along a vertical axis between a retracted position and an extended position. The spindle is spaced further from the base member in the extended position than in the retracted position.

The wall panel system further includes a pivoting portion pivotally coupled to the sliding wall panel assembly, and a pivot lock. The pivot lock includes a first lock member, a second lock member and a coupling mechanism extending between the first and second lock members. The first lock member is movable between an extended position in which the first lock member extends between the sliding portion and the track and prevents relative motion therebetween, and a retracted position in which the first lock member is positioned to permit relative motion between the sliding portion and the track. The second lock member is movable between an extended position in which the second lock member extends between the sliding portion and the pivoting portion and prevents relative motion therebetween, and a retracted position in which the second lock member is positioned to permit relative motion between the sliding portion and the pivoting portion. The coupling mechanism couples the first and second lock members so that when the first lock member is in the extended position the second lock member is in the retracted position, and when the first lock member is in the retracted position the second lock member is in the extended position.

These and other features and advantages of the present invention will be appreciated from a review of the following detailed description of the invention, along with the accompanying figures in which like reference numerals refer to like parts throughout.

DETAILED DESCRIPTION OF THE INVENTION

In the following paragraphs, the present invention will be described in detail by way of example with reference to the accompanying drawings. Throughout this description, the preferred embodiments and examples shown should be considered as exemplars, rather than as limitations on the present invention. As used herein, the "present invention" refers to any one of the embodiments of the invention described herein, and any equivalents. Furthermore, reference to various aspects of the invention throughout this document does not mean that all claimed embodiments or methods must include the referenced aspects.

Figure 1:
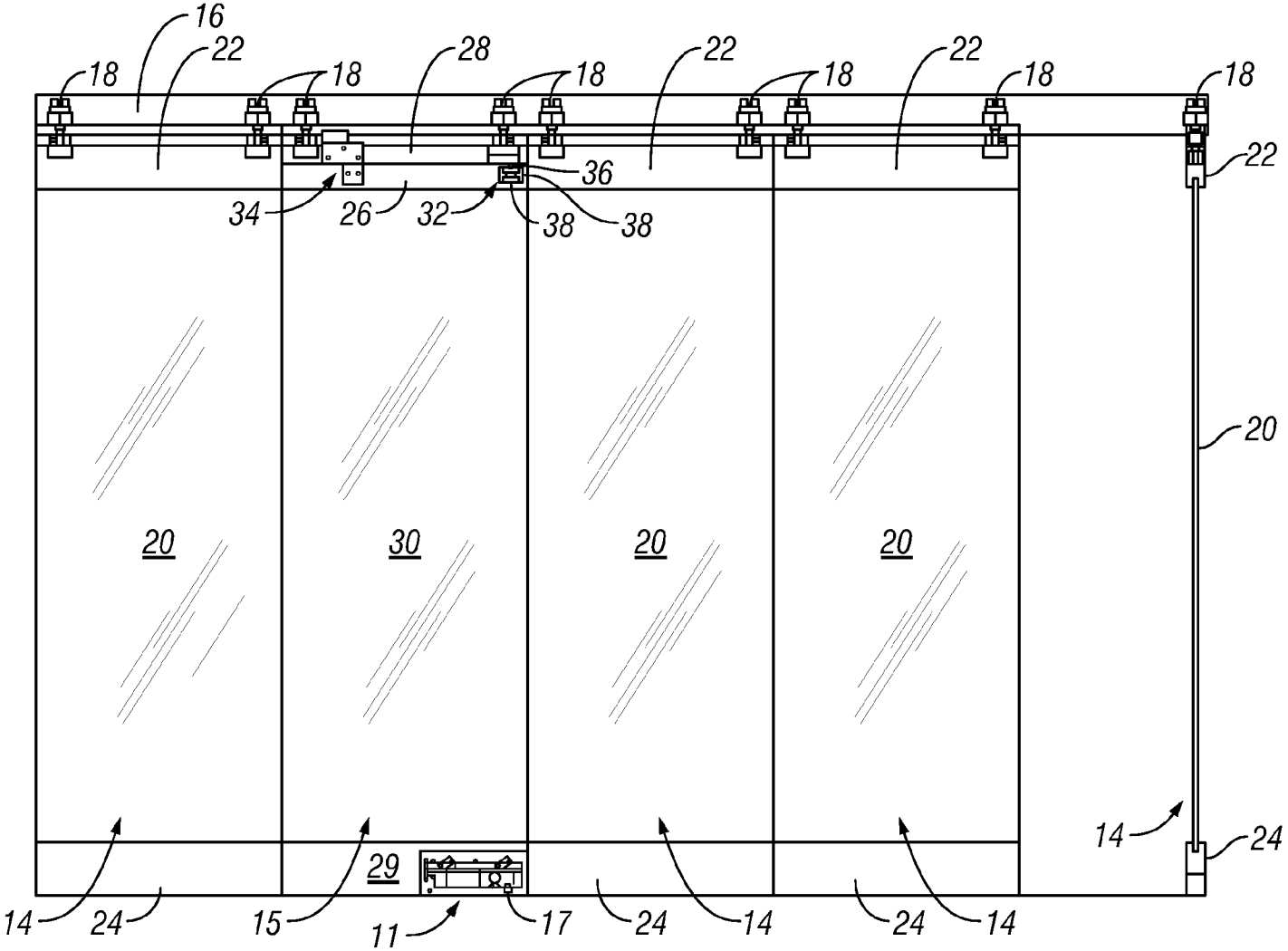
FIG. 1 is a side view of an exemplary embodiment of a wall panel system incorporating a floor anchor in a retracted position in accordance with the present invention.
Figure 2:
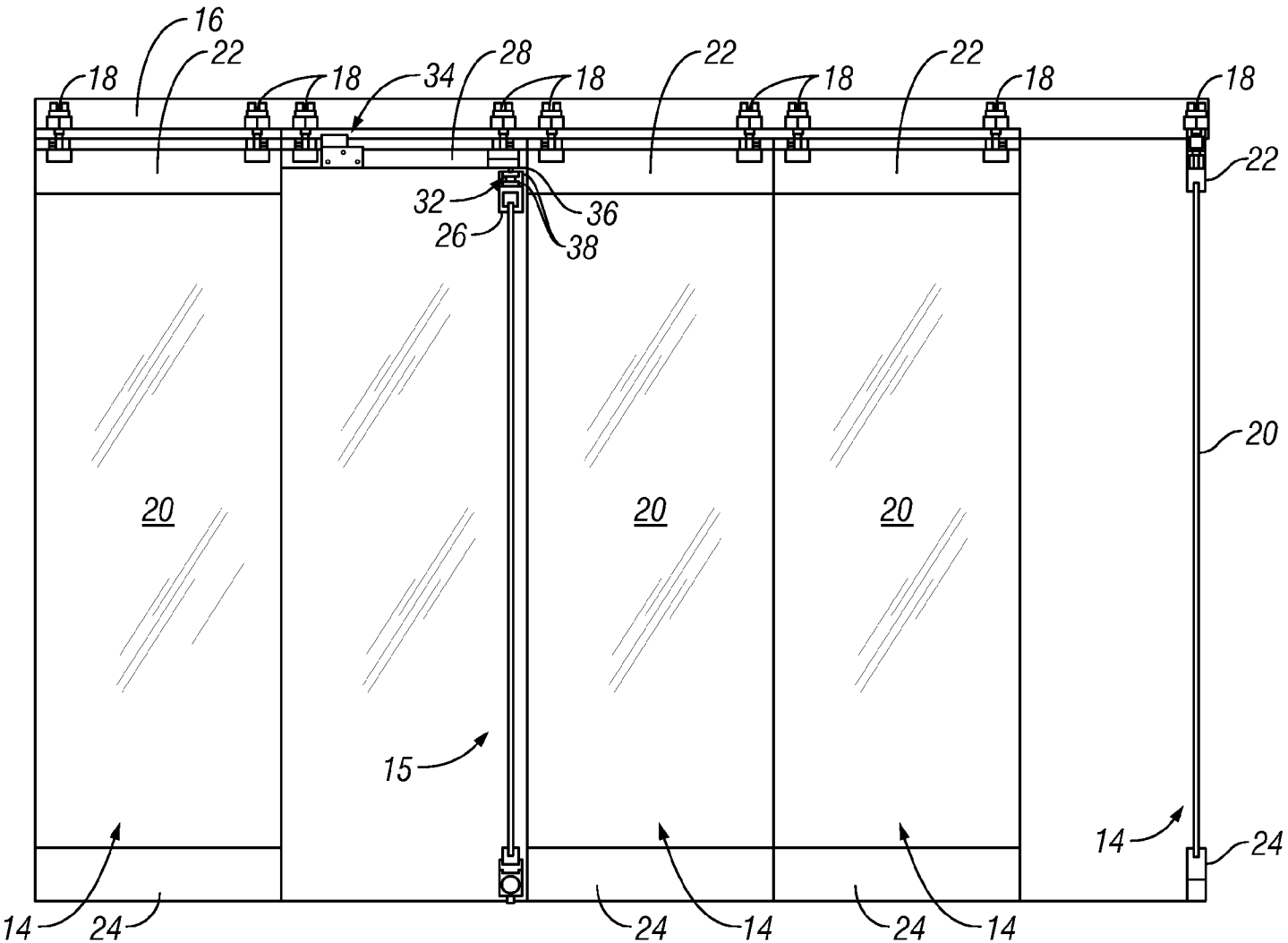
FIG. 2 is another side view of the wall panel system of FIG. 1 with the floor anchor in an extended position.

Referring first to FIGS. 1 and 2, a wall panel system 10 is described in which a floor anchor 11 of the present invention is utilized. In general, door floor anchor 11 allows a pivoting wall panel assembly 15 of wall panel system 10 to be converted between a sliding/rolling configuration and a pivoting configuration. In particular, floor anchor 11 includes retractable spindle 17 that is configured to engage an aperture included in the floor, or in a threshold mounted to the floor, to provide a lower pivoting mechanism. Spindle 17 is coupled to door closer assembly 44 that is also included in floor anchor 11 so that the pivoting wall panel assembly 15 is self-closing. Unlike previous floor anchors, door closer 19 is included in floor anchor 11 rather than in a cavity created in the floor. As a result, installation is greatly simplified because it does not require creating a properly aligned and located cavity in the floor that is large enough to receive a door closer.

Wall panel system 10 includes a plurality of separate wall panel assemblies, including sliding wall panel assemblies 14 and pivoting wall panel assembly 15, suspended from track 16 by a plurality of trolleys 18. Each sliding wall panel assembly 14 is generally constructed from a wall panel 20, an upper rail 22, and a lower rail 24. Wall panel 20 is constructed so that it forms a partition when suspended by track 16. Wall panel 20 may be constructed from any material suitable for providing a movable partition wall, such as glass, wood, metal, composites or any combination thereof. In a preferred embodiment, wall panel 20 is constructed from tempered glass so that it provides a transparent physical barrier.

Upper rail 22 and wall panel 20 are mechanically coupled so that wall panel 20 may be suspended from upper rail 22. Upper rail 22 includes a channel that receives an upper edge of wall panel 20. Upper rail 22 and wall panel 20 may be coupled by mechanical clamping, bonding or other fasteners that are sufficient to support the weight of wall panel and any additional hardware mounted on wall panel 20.

Similarly, lower rail 24 is also mechanically coupled to wall panel 20 so that wall panel 20 and lower rail 24 may be suspended from track 16. Lower rail 24 includes a channel that receives a lower edge of wall panel 20 and the parts are coupled by mechanical clamping or bonding.

Upper and lower rails 22 and 24 may be constructed from any rigid material such as steel, aluminum and composite. Additionally upper and lower rails 22 and 24 may be provided in any desired finish. For example, the rails may be provided in a satin finish, dark bronze, stainless steel, etc.

Pivoting wall panel assembly 15 differs from wall panel assemblies 14 in that it includes an upper rail assembly that is constructed from pivot rail 26 and slide rail 28. Pivot rail 26 includes a channel that receives an upper edge of wall panel 30. Pivot rail 26 and wall panel 30 may be coupled by mechanical clamping, bonding or fasteners. As shown in FIG. 1, pivoting wall panel assembly 15 is configured to be slid or rolled along track 16. In that sliding configuration, pivot rail 26 is suspended from slide rail 28 by pivot assembly 32 adjacent to a first end of pivot rail 26 and pivot lock 34 adjacent to a second end of pivot rail 26.

Pivot assembly 32 is configured to allow pivot rail 26 to rotate relative to slide rail 28 about a vertical axis defined by a vertical axle 36. Axle 36 extends from an upper portion of pivot rail 26 into slide rail 28. Bearings 38 are interposed between axle 36 and pivot rail 26 so that pivot rail 26 rotates about axle 36. Axle 36 and bearings 38 are preferably selected so that it has sufficient strength and rigidity to suspend the entire wall panel assembly 15.

Pivot lock 34 provides a mechanism for selectively coupling pivot rail 26 with slide rail 28 and for selectively coupling slide rail 28 with track 16. In the sliding configuration, shown in FIG. 1, pivot lock 34 is configured to prevent relative rotation between pivot rail 26 and slide rail 28 and to allow relative translation between slide rail 28 and track 16. Conversely, in the pivoting configuration, shown in FIG. 2, pivot lock 34 is configured to allow relative rotation between pivot rail 26 and slide rail 28 and to prevent relative translation between slide rail 28 and track 16.

Figure 23:
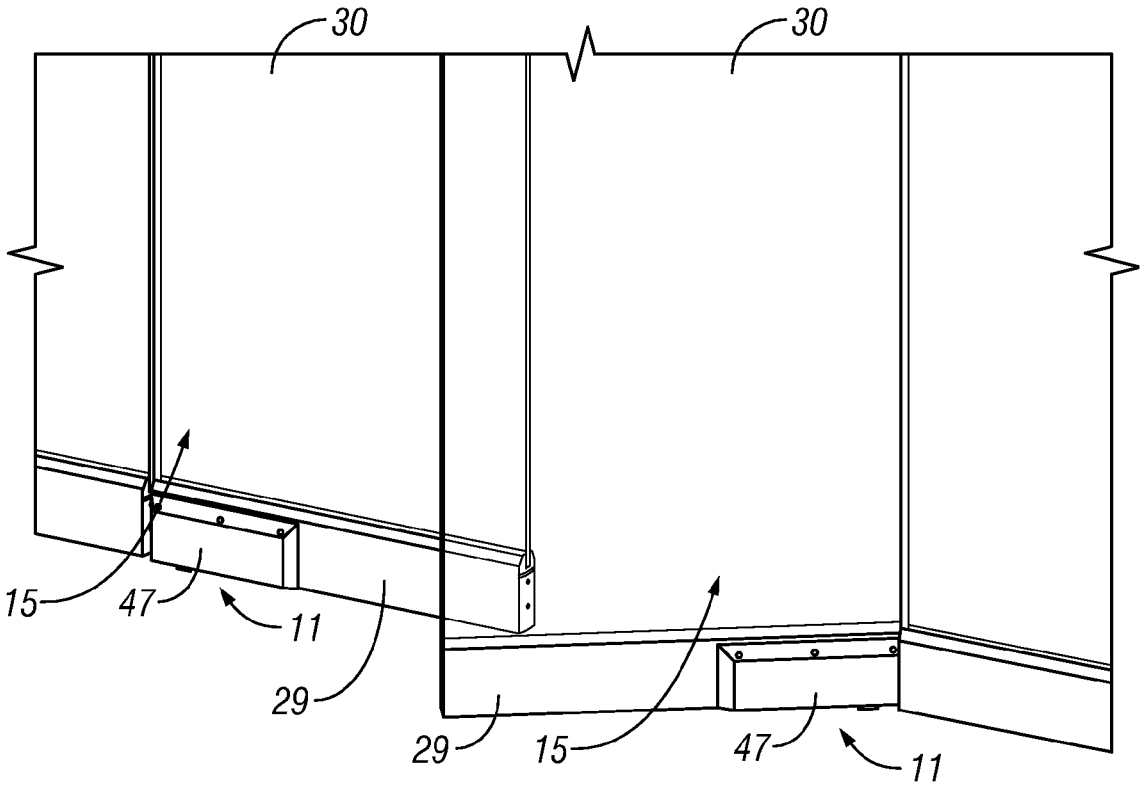
FIG. 23 is a view of an embodiment of a wall panel system in accordance with the present invention in which a panel is swinging open.

In one embodiment, floor anchor 11 is integrated into lower rail 29 of wall panel assembly 15 and enclosed by a removable cover 42. In particular, a cavity is included in a lower end portion of rail 29 that is sized to receive the components of anchor 11. Floor anchor 11 is enclosed by inside cover plate 42 and outside cover plate 47, although it should be understood that the terms "inside" and "outside" are used hereinafter to identify the plates, not necessarily whether one or the other must face an "inside" area or an "outside" or outdoors area. The inside cover plates 42 can be seen on wall panel assemblies 15 that are "swinging" open in FIG. 22, and the outside cover plates 47 can be seen on wall panel assemblies 15 swinging open in FIG. 23. Outside cover plate 47 is also shown in detail in FIGS. 18A-C and 21. As shown in FIGS. 3, 4, 19A, 20 and 22, inside cover plate 42 includes aperture 43 to allow access to the side of the closer device, which comprises an input control interface 55 coupled to a camming link 54 of anchor 11. The user may access the input control interface 55 through aperture 43 to actuate anchor 11, and in particular, to selectively retract or extend spindle 17, as will be described in greater detail below.

Figure 3:
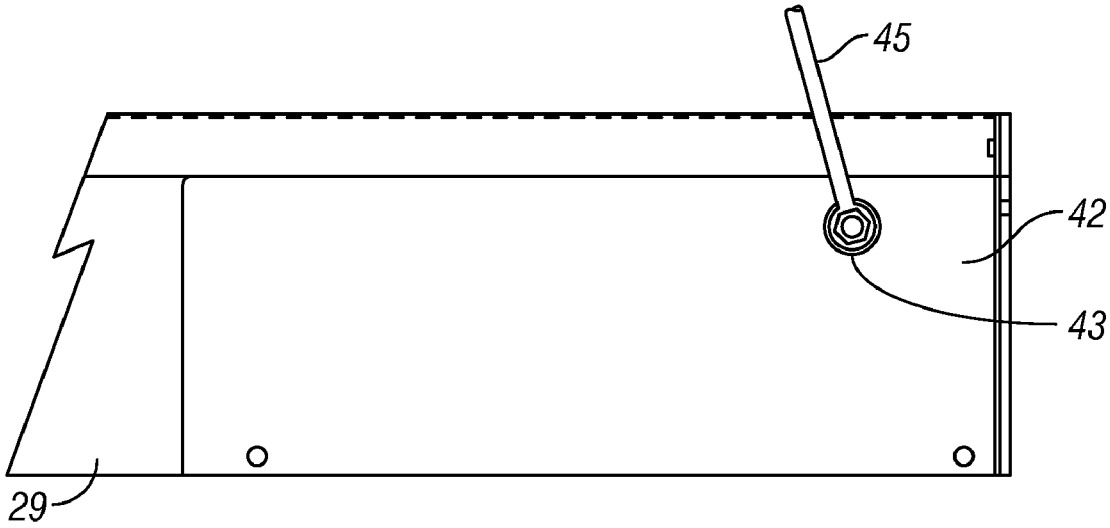
FIG. 3 is a side view of a portion of the swinging door including the floor anchor in a retracted position
Figure 4:
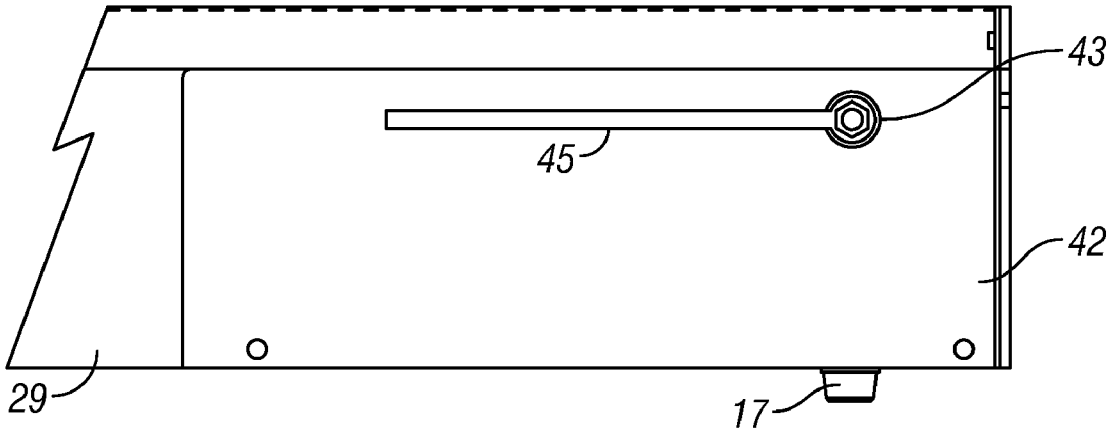
FIG. 4 is another side view of a portion of the swinging door including the floor anchor in an extended position.

For example, as shown in FIGS. 3 and 4, a user may use a tool 45 that is adapted to engage the input control interface 55 and to rotate camming link 54 to retract or extend spindle 17. In a preferred embodiment, the tool is a spanner wrench, which interfaces with an adjustment mechanism that provides a door swing adjustment, for example in a desired range such as plus or minus 3 degrees or more. This adjustment aligns the handle side vertical door edge with the adjacent glass panel during pivot door mode.

Track 16 defines the path of sliding/rolling travel of wall panel assemblies 14 and pivoting wall panel assembly 15 of wall panel system 10. Track 16 is generally an elongate tubular member that includes a channel extending from the interior to the exterior of the tubular member. A roller portion of each trolley 18 is configured to roll freely within the interior of track 16.

Each trolley 18 includes a vertical axle, such as a pendant bolt, that extends downward from the roller portion of trolley 18 and is coupled to either upper rail 22 of wall panel assembly 14 or slide rail 28 of pivoting wall panel assembly 15. The pendant bolt is configured to rotate relative to the remainder of trolley 18, thereby providing a rotating interface between wall panel assembly 14, or pivoting wall panel assembly 15, and trolley 18.

In the illustrated embodiment, wall panel system 10 employs a plurality of wall panel assemblies 14 and a single pivoting wall panel assembly 15, each of which is supported by two trolleys 18 engaged with track 16. Each wall panel assembly 14, 15 is separate from the others so that each may be separately translated along track 16 and stacked if desired.

Figure 5:
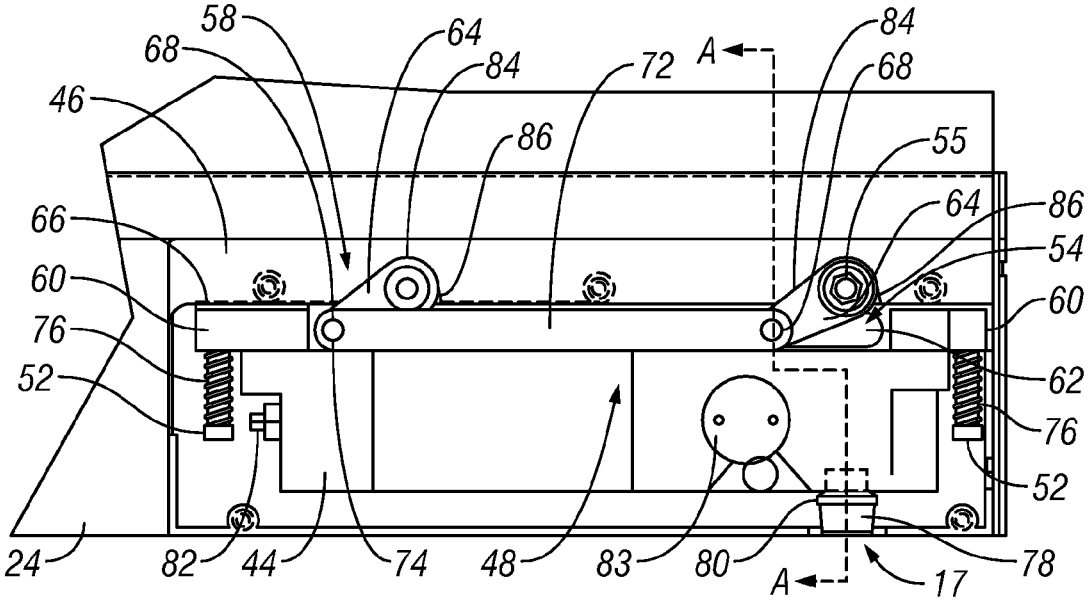
FIG. 5 is a partial cross-sectional side view of a floor anchor in a retracted position.
Figure 6:
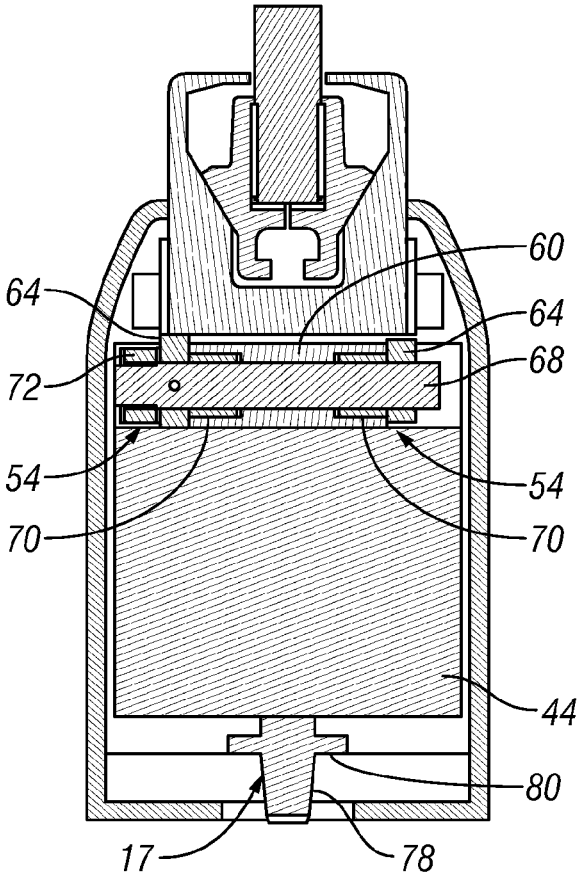
FIG. 6 is a cross-sectional end view taken along line A-A of the floor anchor of FIG. 5.

Referring to FIGS. 5 and 6, floor anchor 11 is shown with spindle 17 in the retracted position. Floor anchor 11 generally includes base 46, door closer assembly 44, spindle 17 and linear actuator 48. Linear actuator 48 generally extends between base 46 and spindle 17 and is configured to selectively translate spindle 17 between the retracted position and the extended position.

In the present embodiment, base 46 is a portion of lower rail 29 that provides a mounting structure for a portion of linear actuator 48 that is stationary relative to lower rail 29 and wall panel 30. In the present embodiment, base 46 is a plate that is received in a cavity defined by lower rail 29 generally below pivot assembly 32. Base 46 provides a support structure for mounting links that are included in linear actuator 48 as well as guide members 52 that are used to define the path of travel of spindle 17. It should be appreciated that base 46 may alternatively be a separate component that is fixedly coupled to lower rail 29 using any fastening method, such as, for example, threaded fasteners, rivets or welding.

Linear actuator 48 couples base 46 and spindle 17 so that spindle 17 may be selectively translated between the retracted position and the extended position. In the present embodiment, linear actuator 48 is constructed from a plurality of linkages that interact to translate spindle 17 along a vertical axis. In particular, linear actuator 48 includes input camming link 54 that is pivotally coupled at a first end to base 46 and slidably and pivotally coupled at a second end to translation member 60. Input camming link 54 also includes an input control interface 55 that allows a user to manually actuate linear actuator 48 thereby placing spindle in the extended or retracted position. Linear actuator 48 also includes second camming link 58 that is also pivotally coupled at a first end to base 46 and slidably and pivotally coupled at a second end to translation member 60.

Figure 7:
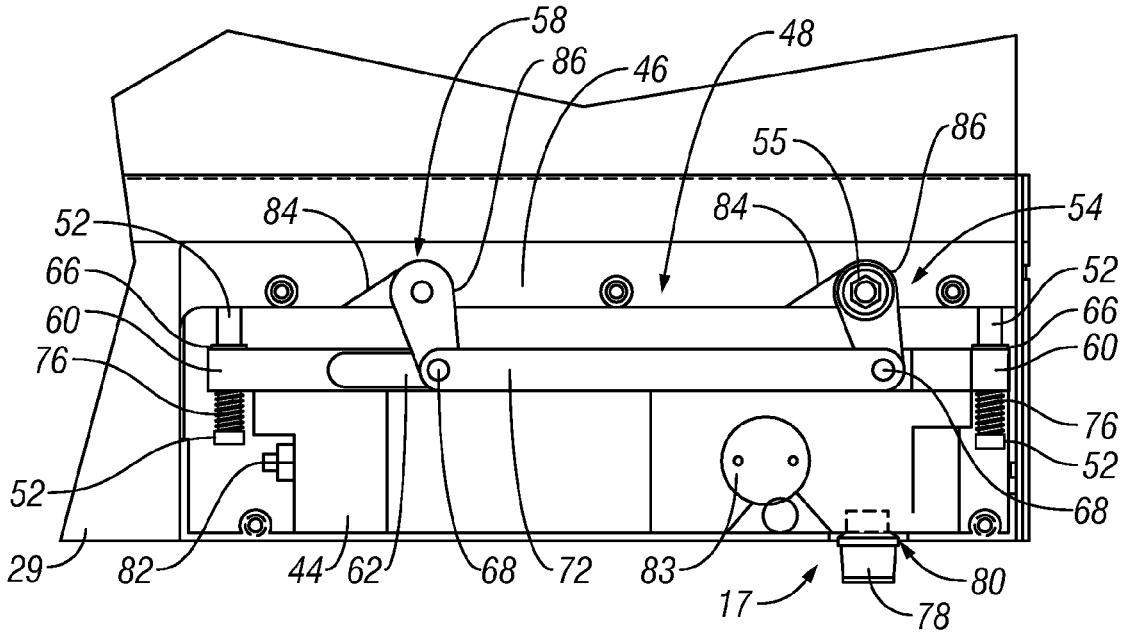
FIG. 7 is a partial cross-sectional side view of a floor anchor of in an extended position.

Translation member 60 is adapted to translate along a vertical axis between a first position, shown in FIGS. 5 and 6, that corresponds with a retracted position of spindle 17 and a second position, shown in FIG. 7, that corresponds with an extended position of spindle 17. Translation member 60 is adapted to translate upon guide members 52 that define the direction of the path of travel of translation member 60. As one alternative, and as shown in FIGS. 5-7, guide members 52 may be shoulder screws that include threaded end portions that are received in threaded holes included in base 46. Unthreaded portions of guide members 52 extend through apertures included in translation member 60. Bushings 66 or linear bearings may be provided in the apertures to reduce friction during relative motion between translation member 60 and guide members 52. Translation member 60 also includes a plurality of slots 62 each of which receives an end portion of a respective camming link 54, 58.

Each camming link includes a pair of arms 64 that extend between base 46 and translation member 60. The first end of each arm is pivotally coupled to base 46, for example by shoulder screw 64 a portion of which is threadably received by base 46. In the present embodiment, the location of the pivoting connections of the camming links are aligned vertically on base 46 such that a line extending through those locations is perpendicular to the direction of travel of translation member 60.

Each of camming links 54 and 58 are also coupled to translation member 60. Translation member 60 includes a plurality of slots 62 each of which receives a pin 68 that extends between the second ends of arms 64 of each camming link 54, 58. Pins 68 extend through slots 62 and are adapted to translate within slots 62 in response to rotation of input camming link 54, i.e., pins 68 are translatably coupled to translation member 60. In the present embodiment, rollers 70 are provided on pins 68 to reduce friction during translation of pins 68 relative to translation member 60. It should be appreciated that rollers 70 may be any device capable of reducing friction between pins 68 and translation member 60, such as self-lubricating bushings, or bearings.

A coupling member 72 extends between camming links 54 and 58 and assures that rotation of input camming link 54 is transmitted directly into rotation of second camming link 58. In the present embodiment, coupling member 72 is an elongate link that extends between the second ends of camming links 54 and 58. Each end of coupling member 72 includes an aperture 74 that receives a portion of a respective pin 68 to form a pivotal connection therebetween. Coupling member 72 is received in a laterally recessed portion of translation member 60 so that the lateral dimension of anchor 11 may be minimized.

Biasing members 76 are provided to urge translation member 60 toward base 46. In the present embodiment, biasing members 76 are coupled to each guide member 52 and are helical springs that are disposed coaxially upon guide members 52 and interposed between a head of each guide member 52 and translation member 60. The springs are selected and positioned so that they are under compression between the head and translation member 60 and, as a result, apply a force upon translation member 60 in the direction of base 46, i.e., the force exerted by biasing member upon translation member 60 urges translation member 60 toward base 46. It should be appreciated that any biasing member may be utilized, such as helical springs, Belleville washers, and/or magnets. It should also be appreciated that biasing members 76 may be positioned between any components in anchor 11 and may be configured to be in tension rather than compression if desired.

Spindle 17 is coupled to translation member 60 such that it translates with translation member 60 in response to actuation of linear actuator 48. Spindle 17 provides a link between anchor 11 of pivoting wall panel assembly 15 and a floor surface below wall panel assembly 10. Spindle 17 includes a body portion 78 and a flange portion 80. Body portion 78 is shaped and sized to be inserted into an aperture included in the surface that is below pivoting wall panel assembly 15 when it is mounted in wall panel system 10. Flange portion 80 is disposed at an upper end of body portion 78 and has an outer lateral dimension that is larger than a corresponding lateral outer dimension of body portion 78. In the present embodiment, body portion 78 has a generally rectangular cross-sectional shape and flange portion 80 is generally disk-shaped.

Door floor anchor 11 also includes door closer 44 so that pivoting wall panel 15 may be self-closing when it is in a pivoting configuration. Door closer 44 is coupled to translation member 60 so that door closer 44 translates with translation member 60 and spindle 17. Spindle 17 extends from door closer 44 and is mechanically coupled to the internal mechanism of door closer 44 so that it is biased to rotate to a predetermined position. For example, door closer 44 may be configured so that spindle is biased to rotate to a position that corresponds to pivoting wall panel assembly 15 in a closed position. However, it should be appreciated that door closer 44 and spindle 17 may be oriented so that the neutral position corresponds to door panel assembly 15 in any desired position.

Door closer 44 may also be provided with controls that allow a user to adjust the position of spindle 17, the closing speed and the amount of force required to open and close wall panel assembly 15 when it is in a pivoting configuration. For example, a door centering adjustment control 82 is provided on a side of door closer 44 that allows small adjustment of the position of spindle 17 in a horizontal plane. Adjustment control 82 may be used so that spindle 17 may be easily aligned vertically under pivot assembly 32 during assembly of wall panel system 10. Door closer 44 may also be provided with an adjustment valve 82 and control 83 that may be used by a user to adjust the self-closing speed of panel 15, the forces necessary for pivotally opening and closing wall panel 15 and/or the alignment of spindle 17.

Referring to FIGS. 12-17, floor fitting 88 serves to secure anchor 11 to the floor and allow pivoting of wall panel assembly 15. The floor fitting 88 can also be used to adjust the vertical alignment of the panel assembly. Floor fitting 88 comprises housing 90 and spindle receiver 92 and is adjustable for receiving spindle 17 from door closer 44. Housing 90 further comprises receiving boss 102, which receives spindle 17 as housing 90 is fitted over spindle 17 and lowered into first hole 94 in the floor. The housing 90 preferably has a serrated bottom surface. The serrations 104 facilitate movement of the floor fitting 88 back and forth when wall panel assembly 15 pivots. Serrations 104 further serve to hold the weight of the wall panel assembly and provide the necessary friction to hold the wall panel assembly in place. As can best be seen in FIG. 17, floor fitting 88 has a top cover plate 98 and a bumper 100 to hold the cover plate in place. After the wall panel assembly is parked in place in a closed configuration, cover plate 98 prevents the heels of the panel assembly from falling into the housing 90.

Floor fitting 88 provides significant advantages in that it is quite small in size and very easy to install compared to existing floor fittings. To accommodate floor fitting 88, first hole 94 need be only 2¼ inches in diameter and should be at least 1¼ inches deep. Two smaller holes in the floor are made to receive self-threading bolts 96, which serve to hold the system down.

Each wall panel assembly 14 includes at least one panel lock assembly 12 so that it may be locked in position when it is placed in its predetermined closed position. Referring to FIG. 5, panel lock assembly 12 is located within a cutout 52 provided at the edge of wall panel 20. Locating panel lock assembly 12 within cutout 52 allows it to be spaced the greatest distance from the next adjacent connection point to an adjacent panel or a hinge point while allowing panel lock assembly 12 to be concealed within wall panel assembly 14. The concealment of panel lock assembly 12 prevents tampering, allows the thickness of wall panel assembly 14 to be minimized and provides aesthetic appeal by reducing the surface area of wall panel dedicated to panel lock assembly 12.

As described briefly above, pivoting wall panel assembly 15 may be selectively converted between a sliding configuration and a pivoting configuration. In the sliding configuration, anchor 11 is in a retracted configuration and pivot lock 34 is configured so that pivot rail 26 is locked with slide rail 28 and slide rail 28 is free to translate along track 16. When it is desired to convert pivoting wall panel assembly 15 into a pivoting configuration, wall panel assembly 15 is first translated into a predetermined pivot position along track 16. The predetermined pivot position corresponds to a location at which track 16 is configured to be fixedly coupled to slide rail 28 by pivot lock 34. Additionally, the predetermined pivot location also corresponds to a location at which spindle 17 is located over and aligned with a receiving feature, such as an aperture, floor plug or base plate, in the surface below wall panel system 10. As shown in FIGS. 1 and 2, there is a single predetermined pivot position that corresponds with a location where a portion of pivot lock 34 is coupled with track 16 and where an aperture in the floor below wall panel system 10 is aligned with spindle, but it should be appreciated that there may be any number of predetermined pivot positions.

Next, anchor 11 is converted into the extended position so that spindle 17 is received by the receiving feature. Conversion of anchor 11 into the extended position requires that input camming link 54 be rotated from a first position, shown in FIG. 4 to a second position shown in FIG. 6. Input camming link 54 is preferably rotated by a user utilizing a tool that is configured to couple with input control interface 55. Input control interface 55 may be any feature that is capable of transmitting torque from a tool to input camming link 54. For example, input control interface 55 may be a polygonal or star-shaped stud that is adapted to be turned by a tool including a handle and a socket that receives the stud. In other examples, input control interface 55 may be a socket that is configured to receive a wrench, such as an Allen or Torx wrench.

The user rotates input camming link 54 from the first position to the second position. Base 46 and input camming link 54 are configured so that the first position of input camming link 54 is on a first side of a vertical line passing through the pivot connection between base 46 and input camming link 54 and the second position of input camming link 54 is on the opposite side of the vertical line. As a result, rotation of input camming link 54 between the two positions requires that it be rotated past the vertical centerline. It should also be appreciated that the first position is rotated away from the centerline by a greater amount than the second position. As a result, translation member 60 is disposed further away from base 46 when input camming link 54 is disposed in the second position than when input camming link 54 is disposed in the first position.

Figure 8:
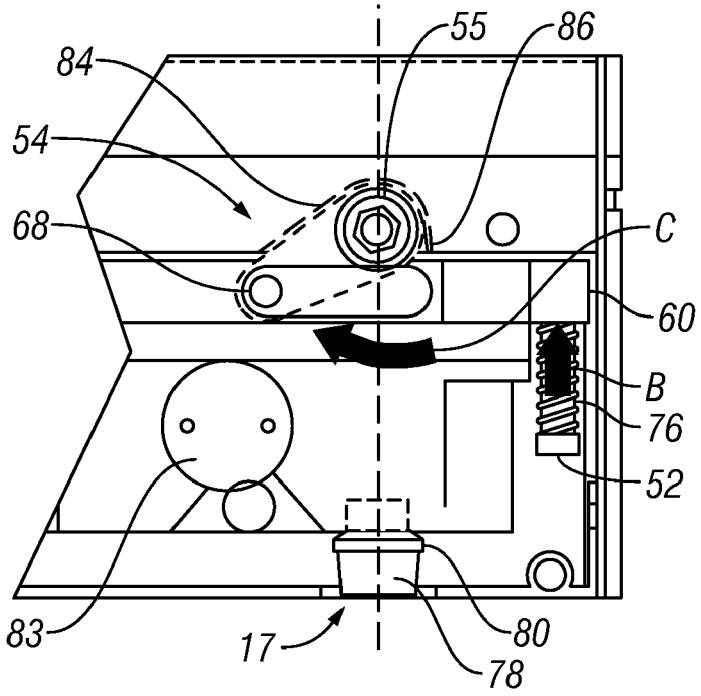
FIG. 8 is a schematic side view of the floor anchor of FIG. 5 illustrating forces acting upon components of the mechanism.

Furthermore, biasing member 76 assists in locking input camming link 54 in either the first position or the second position. For example, as shown in FIG. 8, biasing member 76 is configured to urge translation member 60 toward base 46, shown with arrow B, when input camming link 54 is rotated in the direction of the first position from the centerline, the force exerted by biasing member 76 tends to urge input camming link 54 to rotate further in the direction of the first position, as shown with arrow C.

Figure 9:
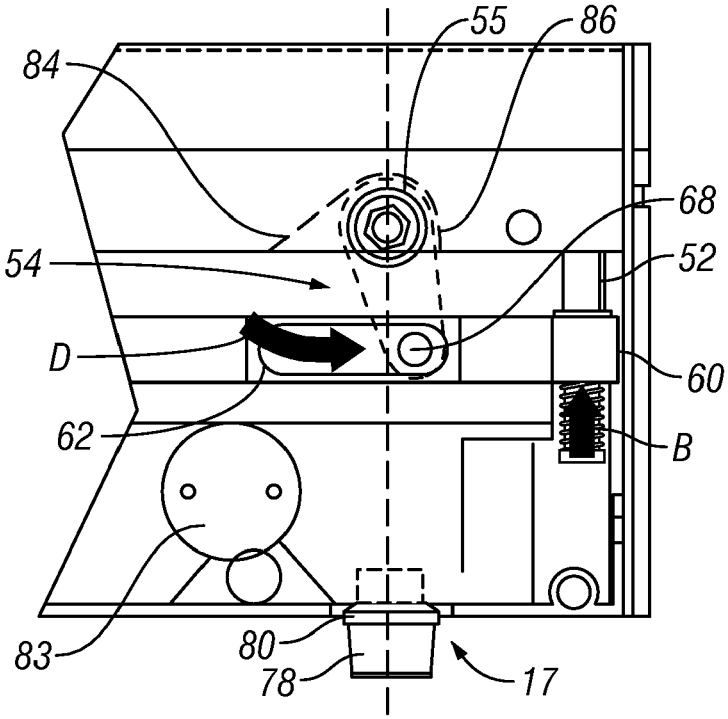
FIG. 9 is another schematic side view of the floor anchor of FIG. 7 illustrating forces acting upon components of the mechanism.

Conversely, as shown in FIG. 9, when input camming link 54 is rotated in the direction of the second position from the centerline, the force exerted by biasing member 76, shown with arrow B, tends to urge input camming link 54 to rotate further in the direction of the second position, as shown with arrow D. In the present embodiment, base 46 includes first shoulder 84 that is oriented and positioned so that it limits the rotation of input camming link 54 in one direction at the first position, and a second shoulder 86 that is oriented and positioned so that it limits the rotation of input camming link 54 in the other direction at the second position. As a result, linear actuator 48 includes détentes at the first and second positions.

Anchor 11 may also be configured so that it supports a portion of the weight of wall panel assembly 15. In such an embodiment, flange portion 80 and/or body portion 78 of spindle 17 may be configured to apply a force upon the floor. That force is then transmitted through the linear actuator 48 to support the wall panel. Additionally, that force assists in maintaining input camming link 54 in the second position.

Finally, after anchor 11 is in the extended configuration and spindle 17 is received in an aperture included in the floor, pivot lock 34 is re-configured. In one embodiment, it is preferred that anchor 11 be converted to the extended position such that spindle 17 is received in the aperture prior to reconfiguring pivot lock 34 to the pivoting configuration so the pivoting portion of wall panel assembly 15 is anchored to the floor when the wall panel rotates between an open and closed position. Pivot lock 34 is configured so that slide rail 28 is coupled to track 16 to prevent relative translation between slide rail 28 and track 16 and so that pivot rail 26 is free to pivot relative to slide rail 28. An embodiment of such a system and its operation also is described in co-pending U.S. patent application Ser. No. 12/056,093, entitled "Wall Panel System Including a Pivot Lock and Method", the full text of which is incorporated herein by reference.

The length and location of the slots included in the translation member may be selected to limit the travel of the linear actuator. For example, the length and position of slots 62 may be used to limit the rotation of input camming links 54, 58. In particular, the fully retracted and fully extended positions of spindle 17 are defined by the travel of linear actuator 48. As previously described, shoulders 84, 86 of base provided limit stops for the rotation of input camming links 54, 58. However, the length and position of slots 62 may be selected to provide desired limit stops for the translation of pins 68 within slots 62.

Figure 10:
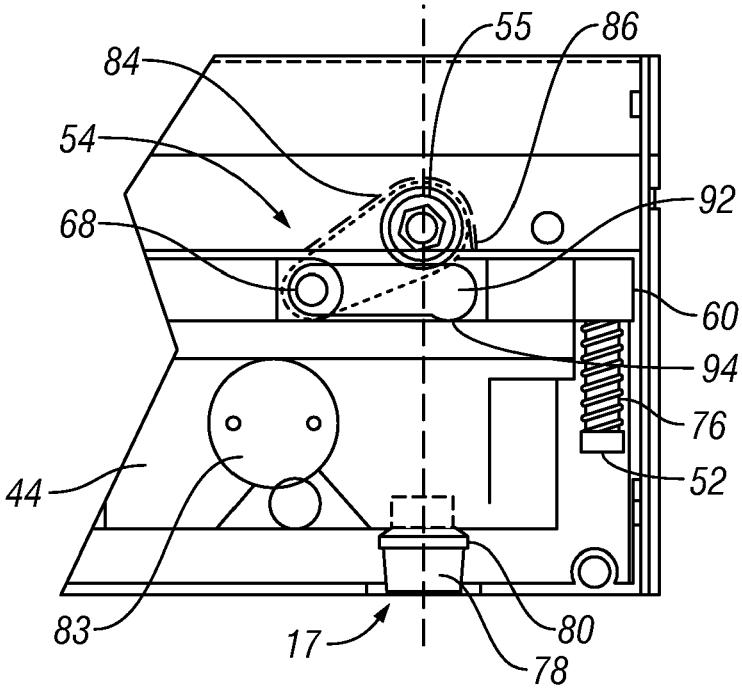
FIG. 10 is a cross sectional view of a portion of another embodiment of the floor anchor in a retracted position.
Figure 11:
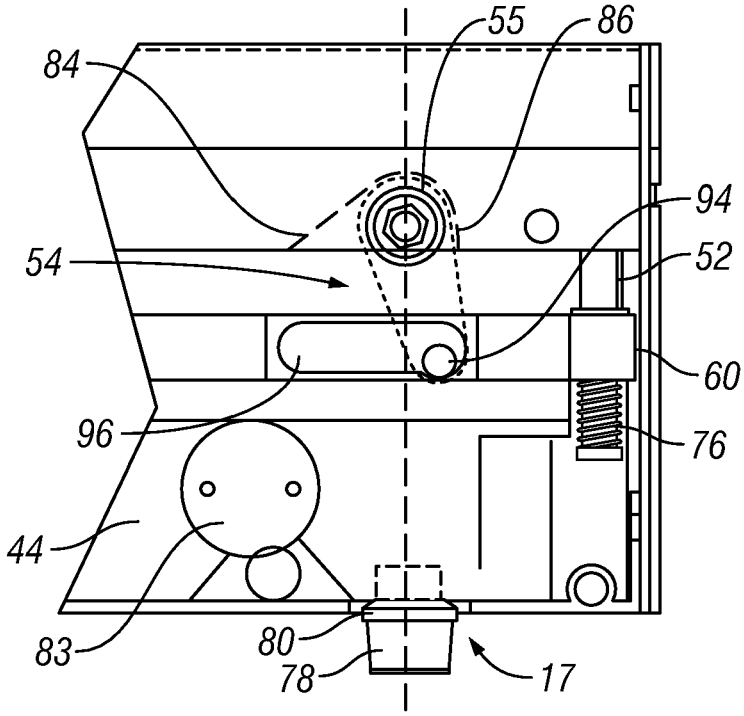
FIG. 11 is another cross-sectional view of the portion of the floor anchor of FIG. 10 in an extended position.
Figure 12:
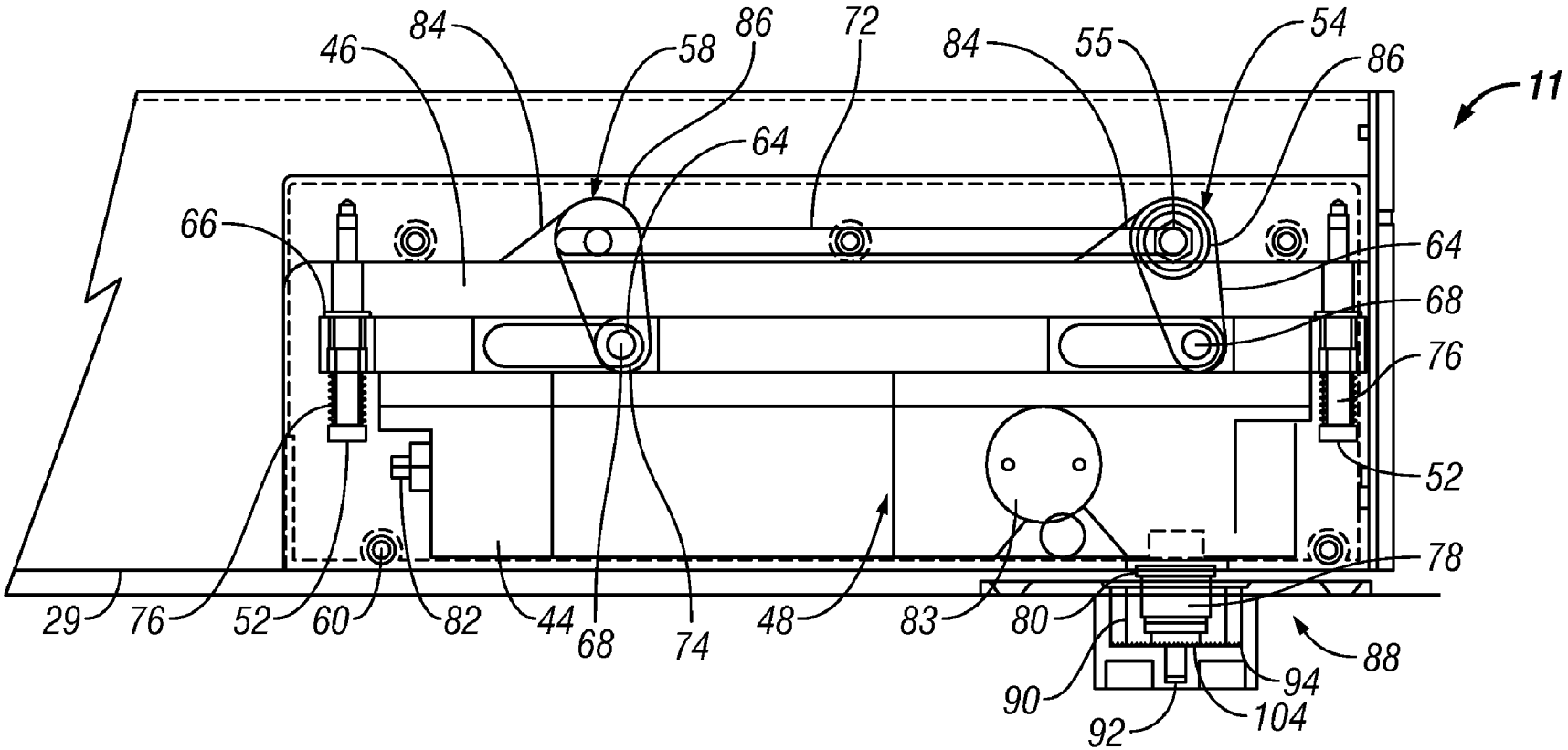
FIG. 12 is a cross-sectional view of an embodiment of the floor anchor in accordance with the present invention.
Figure 13:
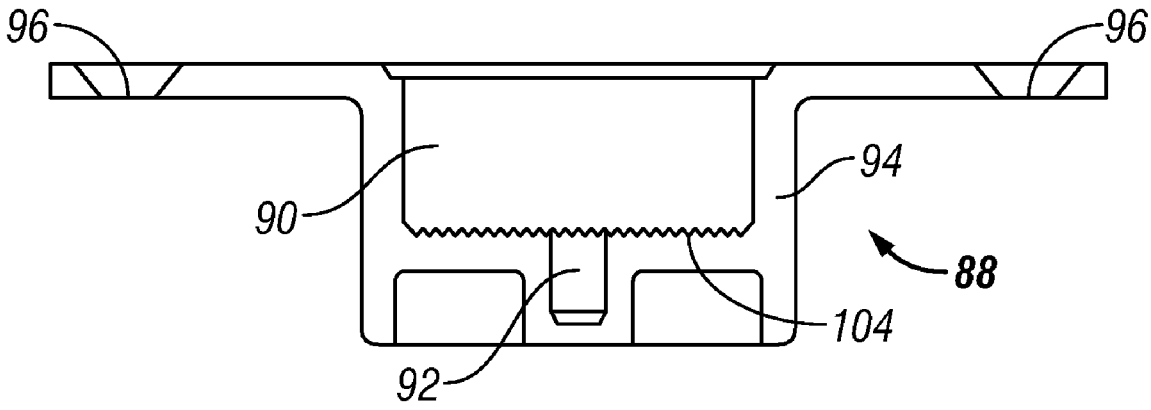
FIG. 13 is a schematic side view of an embodiment of a floor fitting used in accordance with embodiments of the present invention.
Figure 14:
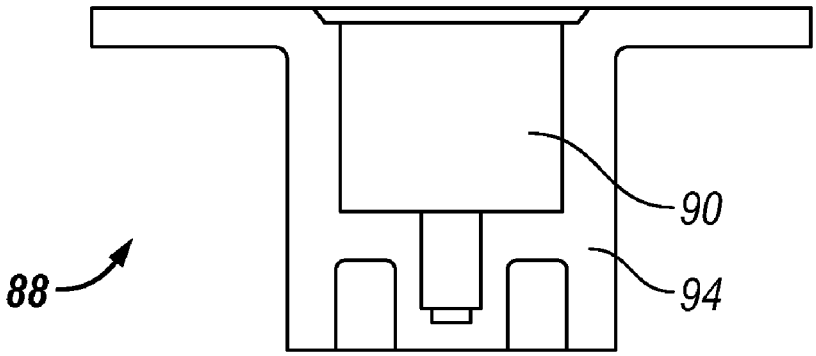
FIG. 14 is a schematic front view of an embodiment of a floor fitting used in accordance with embodiments of the present invention.
Figure 15:
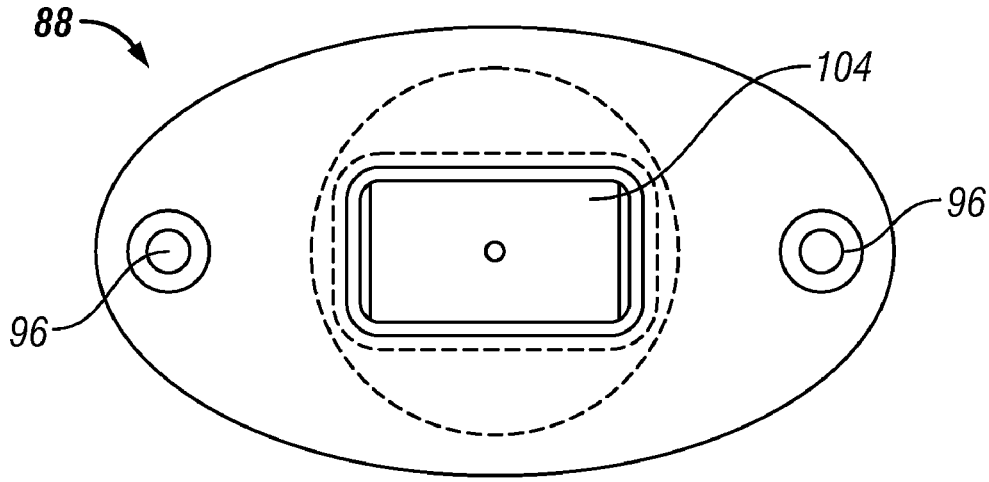
FIG. 15 is a bottom view of an embodiment of a floor fitting used in accordance with embodiments of the present invention.
Figure 16:
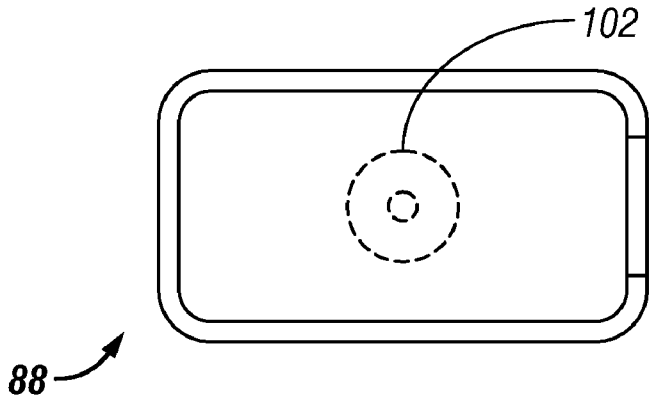
FIG. 16 is a top view of an embodiment of a floor fitting used in accordance with embodiments of the present invention.
Figure 17:
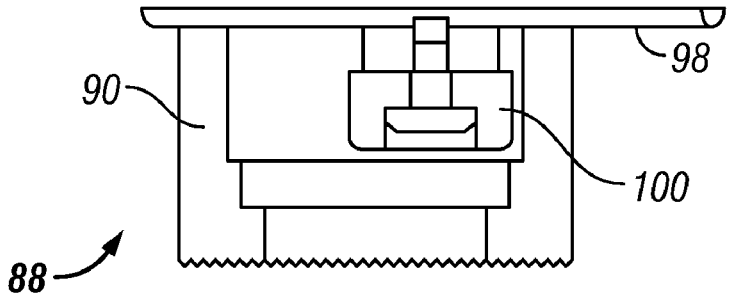
FIG. 17 is a cross-sectional view of an embodiment of a floor fitting used in accordance with embodiments of the present invention.
Figure 18A:
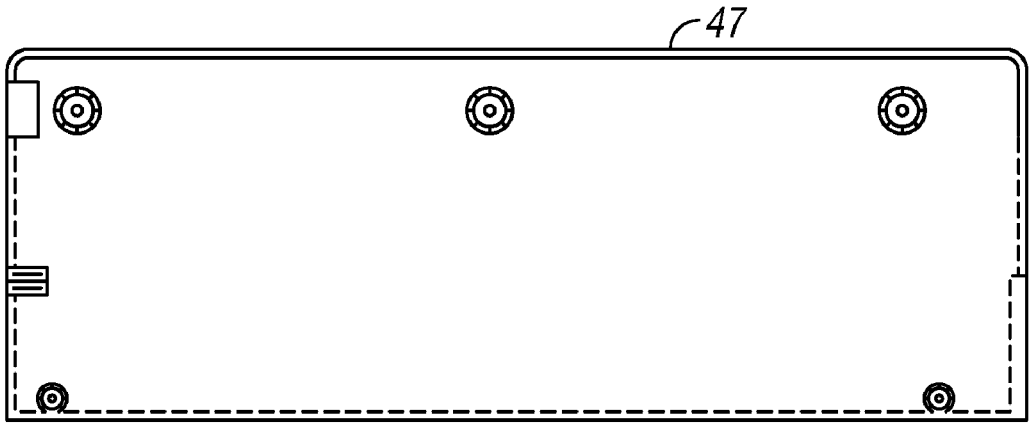
FIGS. 18A-C are schematic views of an embodiment of an outside cover plate used in accordance with embodiments of the present invention.
Figure 18B:
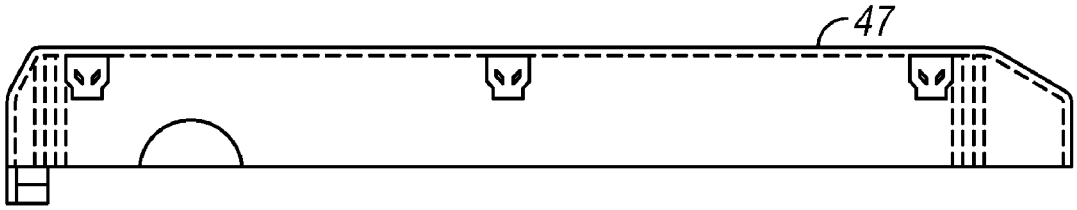
Figure 18C:
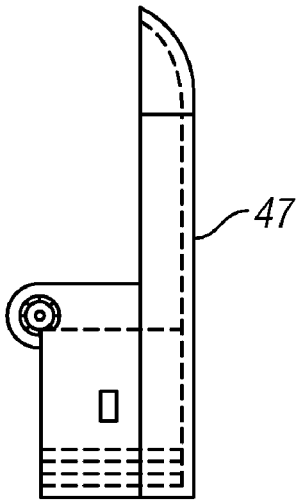
Figure 19A:
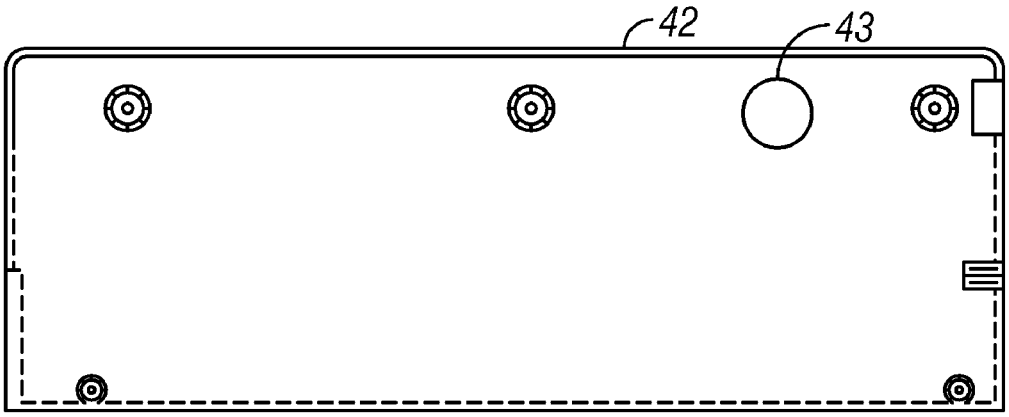
FIGS. 19A-C are schematic views of an embodiment of an inside cover plate used in accordance with embodiments of the present invention
Figure 19B:
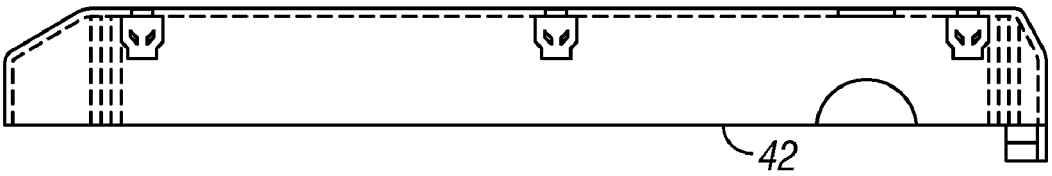
Figure 19C:
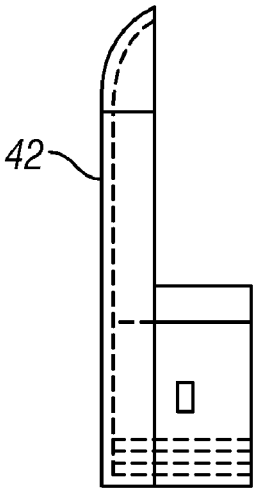
Figure 20:
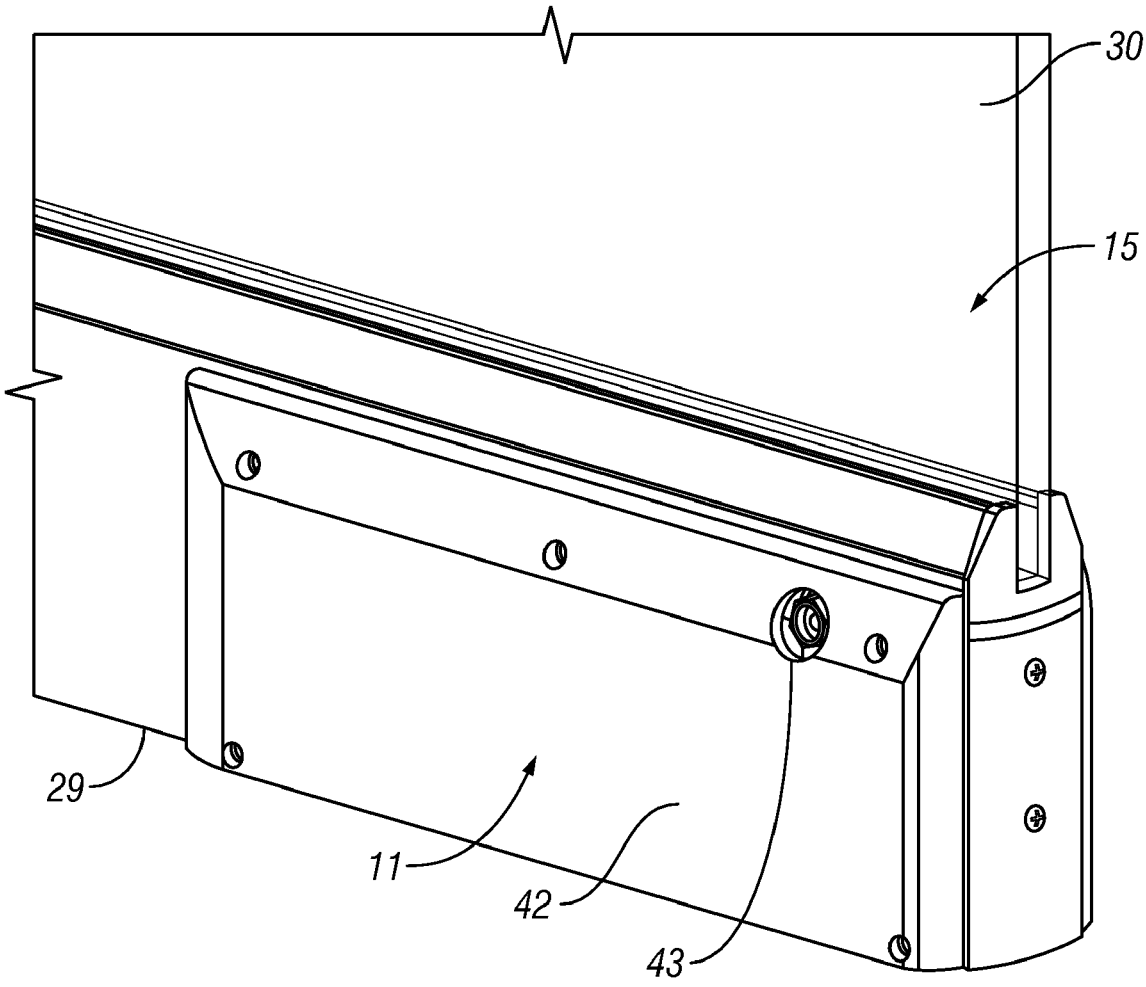
FIG. 20 is a perspective view of an embodiment of a floor anchor in accordance with the present invention.
Figure 21:
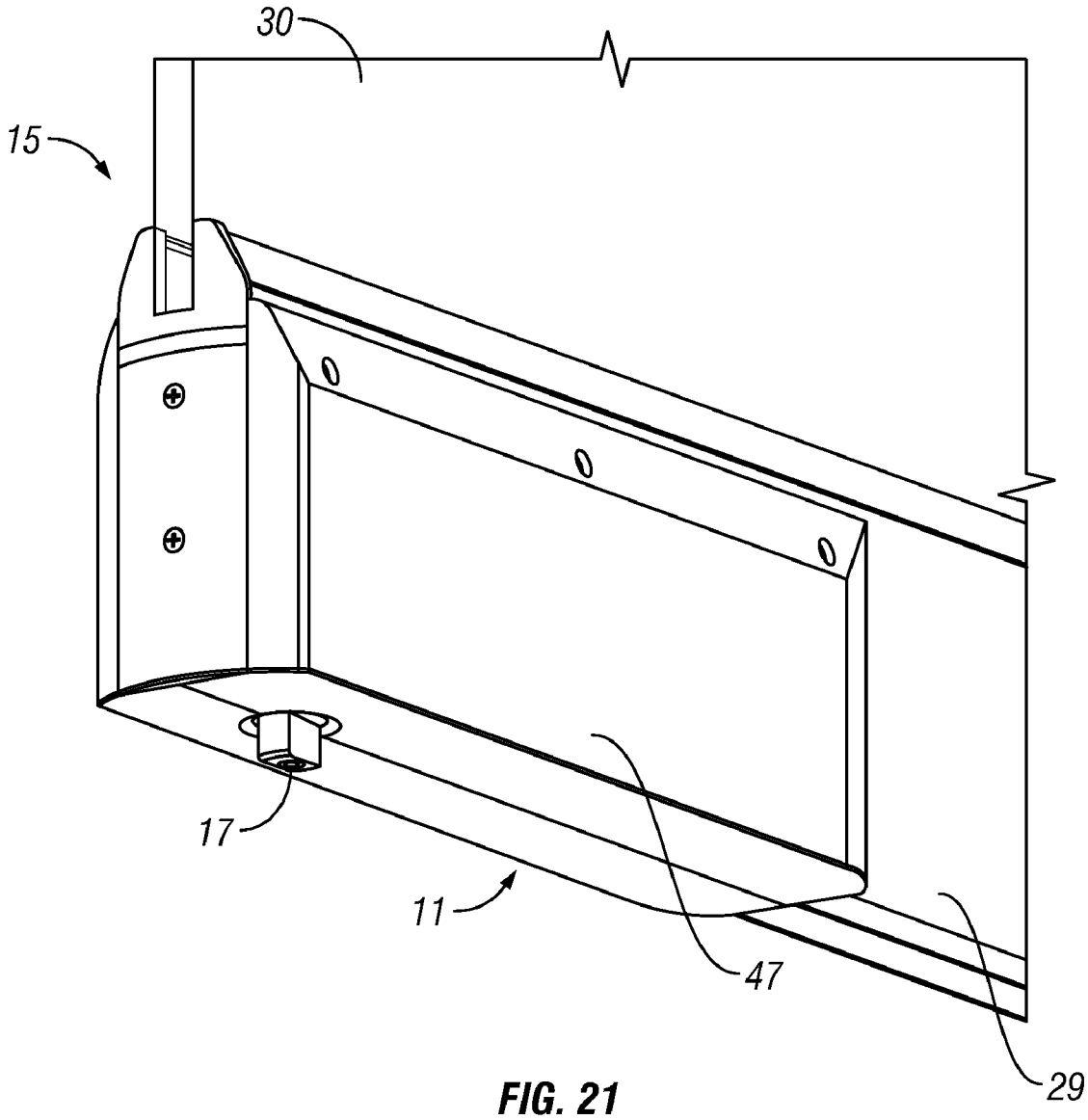
FIG. 21 is a perspective view of an embodiment of a floor anchor in accordance with the present invention.
Figure 22:
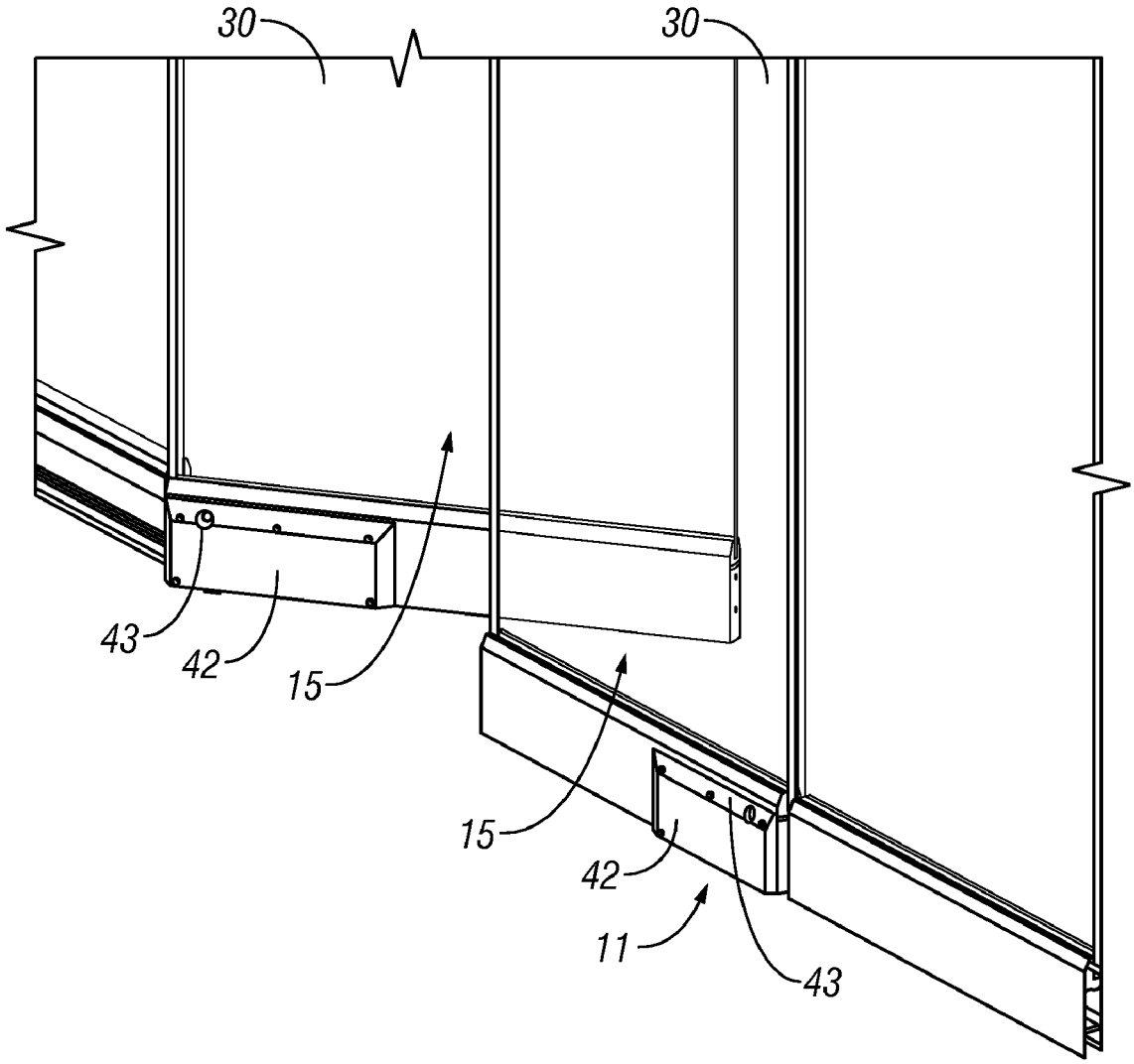
FIG. 22 is a view of an embodiment of a wall panel system in accordance with the present invention in which a panel is "swinging" open.

Additionally, the shape of the slots may be selected to provide desired behavior. Referring to FIGS. 10 and 11, another embodiment of the floor anchor will be described. Floor anchor 90 is generally constructed identically to the previously described embodiments with the exception of alternatively shaped slots 92. Therefore, the remainder of the components will not be further described and identical reference numerals are used.

In floor anchor 90, the lower surface of slot 92 includes trough 94 that is sized to receive at least a portion of pin 68 included in input camming links 54,58. In such an embodiment, when input camming links 54, 58 are located in the second position, as shown in FIG. 9, pins 68 are located in respective troughs 94. Rotation of input camming links 54, 58 from the second position to the first position, shown in FIG. 8, requires additional torque so that translation member 60 is translated against the force provided by biasing members 76 a sufficient distance away from base 46 to allow pin 68 to exit trough 94.

As shown, troughs 94 are incorporated in slots 92 to provide a more robust locking of linear actuator in the extended position. However, it should be appreciated that that any number of troughs may be provided to provided locking at multiple positions. Additionally, as shown in the previous embodiments, input camming links 54, 58 were rotated past a vertical position when transitioning between the retracted and extended positions of spindle 17. That feature in combination with the force exerted on translation member 60 by biasing member 76 allowed shoulders 84, 86 and the location of slot 62 to be used to provide locking positions of linear actuator. The troughs may also be used so that the first and second positions are located such that input camming link is not required to rotate past the centerline when it is rotated between the first and second positions.

It should be appreciated that other configurations of the pivoting wall panel may be incorporated that utilize different rail configurations and a floor anchor. For example, in an alternative embodiment, the pivoting wall panel assembly includes a slide rail that is disposed in a side-by-side relationship with a pivot rail and the slide rail and pivot rail are hinged so that the pivot rail may rotate relative to the slide rail.

Thus, it is seen that a floor anchor system and method of use are provided. One skilled in the art will appreciate that the present invention can be practiced by other than the preferred embodiments which are presented in this description for purposes of illustration and not of limitation, and the present invention is limited only by the claims that follow. It is noted that equivalents for the particular embodiments discussed in this description may practice the invention as well.

What is claimed is:

1. A retractable floor anchor system, comprising:

a panel;

lower rail mounted on a lower portion of the panel;

a base member including a first shoulder and a second shoulder;

a door closer assembly;

a spindle that is rotatably coupled to the door closer assembly; and a linear actuator that moveably couples the base member to the spindle, the linear actuator including an input camming link rotatable from a first position in which the input camming link is on a first side of a vertical line passing through a pivot connection between the base member and the input camming link to a second position in which the input camming link is on a second opposite side of the vertical line;

a translation member fixedly coupled to the door closer assembly;

wherein the linear actuator is adapted to translate the spindle relative to the base member along a vertical axis between a retracted position and an extended position;

wherein the spindle is spaced further from the base member in the extended position than in the retracted position; and wherein the first shoulder is oriented and positioned so that it limits rotation of the input camming link in a first direction when the input camming link is in the first position, and the second shoulder is oriented and positioned so that it limits rotation of the input camming link in a second direction when the input camming link is in the second position.

2. The retractable floor anchor of claim 1 wherein the linear actuator is adapted to translate the translation member, the door closer assembly and the spindle.

3. The retractable floor anchor of claim 2, further comprising a plurality of guide members that extend between the translation member and the base member, wherein the guide members are adapted to define a path of translation of the translation member relative to the base member.

4. The retractable floor anchor of claim 2, further comprising a biasing member configured to bias the spindle to the retracted position.

5. The retractable floor anchor of claim 2, wherein the linear actuator is a mechanical linkage and the input camming link includes a first end that is pivotally coupled to the base member and a second end that is translatably coupled to the translation member.

6. The retractable floor anchor of claim 5, further comprising:

a second camming link that is pivotally coupled to the base member and translatably coupled to the translation member; and a coupling member that extends between the input camming link and the second camming link, wherein the coupling member is adapted to transmit rotation of the input camming link directly to the second camming link.

7. The retractable floor anchor of claim 5, wherein the input camming link includes a pin that extends through a slot included in the translating member, wherein the pin is translatable within the slot.

8. The retractable floor anchor of claim 7, wherein the slot includes at least one trough that is sized to receive at least a portion of the pin.

9. A retractable floor anchor for a wall panel system, comprising:

a panel;

a lower rail mounted on a lower portion of the panel;

a base member;

a door closer assembly;

a spindle that is rotatably coupled to the door closer assembly; and a linear actuator that moveably couples the base member to the door closer assembly;

wherein the linear actuator includes a rotatable input camming link that is pivotally coupled to the base member and translatably coupled to the door closer assembly, the input camming link being rotatable from a first position in which the input camming link is on a first side of a vertical pivot axis defined by a pivot connection between the base member and the input camming link to a second position in which the input camming link is on a second opposite side of the vertical axis, wherein the rotatable input camming link is adapted to rotate between a first position and a second position, wherein the door closer assembly is in a retracted position when the input camming link is in the first position and the door closer assembly is in an extended position when the input camming link is in the second position.

10. The retractable floor anchor of claim 9, further comprising a plurality of guide members that extend between the translation member and the base member, wherein the guide members are adapted to define a path of translation of the translation member relative to the base member.

11. The retractable floor anchor of claim 9, further comprising a biasing member configured to bias the door closer assembly to the retracted position.

12. The retractable floor anchor of claim 9, further comprising:

a second camming link that is pivotally coupled to the base member and translatably coupled to the translation member; and a coupling member that extends between the input camming link and the second camming link, wherein the coupling member is adapted to transmit rotation of the input camming link directly to the second camming link.

13. The retractable floor anchor of claim 9, wherein the input camming link includes a pin that extends through a slot included in the door closer assembly, wherein the pin is translatable within the slot.

14. The retractable floor anchor of claim 13, wherein the slot includes at least one trough that is sized to receive at least a portion of the pin.

* * * * *